US006986316B2

(12) United States Patent
Lonati et al.

(10) Patent No.: US 6,986,316 B2
(45) Date of Patent: Jan. 17, 2006

(54) DEVICE FOR PRECISE PLACEMENT OF THE TOE OF A HOSIERY ITEM DURING AUTOMATED INSERTION THEREOF IN THE CONVEYOR OF A SEWING MACHINE FOR CLOSING THE TOE

(75) Inventors: Ettore Lonati, Brescia (IT); Tiberio Lonati, Brescia (IT); Fausto Lonati, Brescia (IT)

(73) Assignee: Lonati S.p.A., Brescia (IT)

( * ) Notice: Subject to any disclaimer, the term of this patent is extended or adjusted under 35 U.S.C. 154(b) by 0 days.

(21) Appl. No.: 10/831,149

(22) Filed: Apr. 26, 2004

(65) Prior Publication Data

US 2004/0216497 A1 Nov. 4, 2004

(30) Foreign Application Priority Data

Apr. 30, 2003 (IT) ..... MI2003A0896

(51) Int. Cl.
*D04B 23/00* (2006.01)

(52) U.S. Cl. ..... 112/470.15; 112/475.12

(58) Field of Classification Search ..... 112/475.04, 112/475.07, 475.09, 475.12; 66/147, 148
See application file for complete search history.

(56) References Cited

U.S. PATENT DOCUMENTS

| | | | | |
|---|---|---|---|---|
| 5,165,355 A | * | 11/1992 | Fournier et al. | 112/470.08 |
| 5,398,626 A | * | 3/1995 | Rosso et al. | 112/470.15 |
| 6,158,367 A | * | 12/2000 | Jordan et al. | 112/470.08 |
| 6,283,055 B1 | * | 9/2001 | Salvetti | 112/470.15 |

FOREIGN PATENT DOCUMENTS

| | | |
|---|---|---|
| EP | 1 088 925 | 4/2001 |
| WO | 02/084003 | 10/2002 |
| WO | 03/018891 | 3/2003 |

* cited by examiner

*Primary Examiner*—Danny Worrell
(74) *Attorney, Agent, or Firm*—Guido Modiano; Albert Josif; Daniel O'Byrne

(57) ABSTRACT

A device for precise placement of the toe of a hosiery item during automated insertion in the conveyor of a sewing machine for closing the toe, composed of two laminas arranged side by side on a substantially horizontal plane so as to form therebetween a passage for a portion of the hosiery item proximate to the opening of the toe to be closed; the device comprises, proximate to the inlet of the passage, tensioning elements, arranged below the pair of laminas to engage a portion of the toe of the hosiery item, hanging at the toe opening to be closed with two flaps of the opening facing each other and actuated in order to tension the hosiery item downwardly during insertion in the passage.

26 Claims, 5 Drawing Sheets

DEVICE FOR PRECISE PLACEMENT OF THE TOE OF A HOSIERY ITEM DURING AUTOMATED INSERTION THEREOF IN THE CONVEYOR OF A SEWING MACHINE FOR CLOSING THE TOE

BACKGROUND OF THE INVENTION

U.S. Ser. No. 10/459,526 to which reference is made for the sake of completeness, discloses a double-cylinder circular hosiery knitting machine equipped with a device which, at the end of the formation of the hosiery item, extracts from the machine such hosiery item, which is turned inside out and is aspirated into the upper needle cylinder, and automatically inserts it, with the portion of its toe that must be closed, into the conveyor of a sewing machine.

The device that transfers the hosiery item from the double-cylinder circular machine to the conveyor of the sewing machine comprises two grippers, which can engage two diametrically opposite regions of the opening of the toe of the hosiery item to be closed by sewing, so as to hold the hosiery item so that it hangs at its toe to be sewn. The two grippers can be moved apart on command, after engaging the toe of the hosiery item, so as to flatten and move closer the two flaps of the open toe that must be joined by sewing in order to close the toe of the hosiery item.

The two grippers insert the portion of the hosiery item that lies proximate to the opening of the toe to be closed into the conveyor of a sewing machine, which is constituted by two laminas that are arranged side by side on a substantially horizontal plane, so as to form between them a passage for the portion of such hosiery item.

The region of the hosiery item that ends at the toe to be closed is generally produced by providing an additional portion with respect to the actual hosiery item, which is used during the placement of the hosiery item on the sewing machine and is designed to be removed during sewing. This additional portion is composed, starting from the body of the hosiery item, of a few rows of knitting formed with an elastic thread that has a reduced diameter and of a final border that is thicker than said rows. The hosiery item is gripped by the grippers at the thicker border and is dragged by the grippers, which move above the laminas of the conveyor of the sewing machine, so that the insertion of the toe of the hosiery item in the passage formed between the laminas occurs so that the thicker border is arranged above said laminas and the region that is formed with elastic threads of reduced diameter, and therefore has a reduced thickness, is located at the passage formed between the laminas.

In order to achieve a good result in sewing, the thicker border must rest along its entire extension against the upper side of the laminas of the conveyor. This is the only way in which the sewing line or lines will affect the first rows of knitting of the actual hosiery item and the additional hosiery item portion will be removable substantially completely, achieving a scarcely visible seam.

SUMMARY OF THE INVENTION

The aim of the present invention is to provide a device that allows to achieve extremely precise placement of the toe of the hosiery item during its automated insertion in the conveyor of a sewing machine, so as to have a fully satisfactory result in the subsequent sewing operation for closing the toe of the hosiery item.

Within this aim, an object of the invention is to provide a device that allows to rest, along its entire extension, the thicker border of the additional portion of the toe of the hosiery item against the upper side of the laminas of the conveyor.

Another object of the invention is to provide a device that can have a modest space occupation, so that it can be easily applied proximate to conveyors of sewing machines of limited size.

Another object of the invention is to provide a device that ensures high precision and reliability in operation even if the thickness of the hosiery items to be processed varies.

This aim and these and other objects that will become better apparent hereinafter are achieved by a device for precise placement of the toe of a hosiery item during its automated insertion in the conveyor of a sewing machine for closing the toe, said conveyor being composed of two laminas that are arranged side by side on a substantially horizontal plane so as to form between them a passage for a portion of the hosiery item proximate to the toe to be closed by sewing, characterized in that it comprises, proximate to the inlet of said passage, tensioning means, which are arranged below said pair of laminas and can engage a portion of the hosiery item that hangs at the opening of the toe to be closed by sewing so that the two flaps of the opening face each other, said tensioning means being actuatable in order to tension the hosiery item downwardly during its insertion into said passage.

BRIEF DESCRIPTION OF THE DRAWINGS

Further characteristics and advantages of the present invention will become better apparent from the description of a preferred but not exclusive embodiment of the device according to the invention, illustrated by way of non-limiting example in the accompanying drawings, wherein.

DESCRIPTION OF THE PREFERRED EMBODIMENTS

Figure 1:
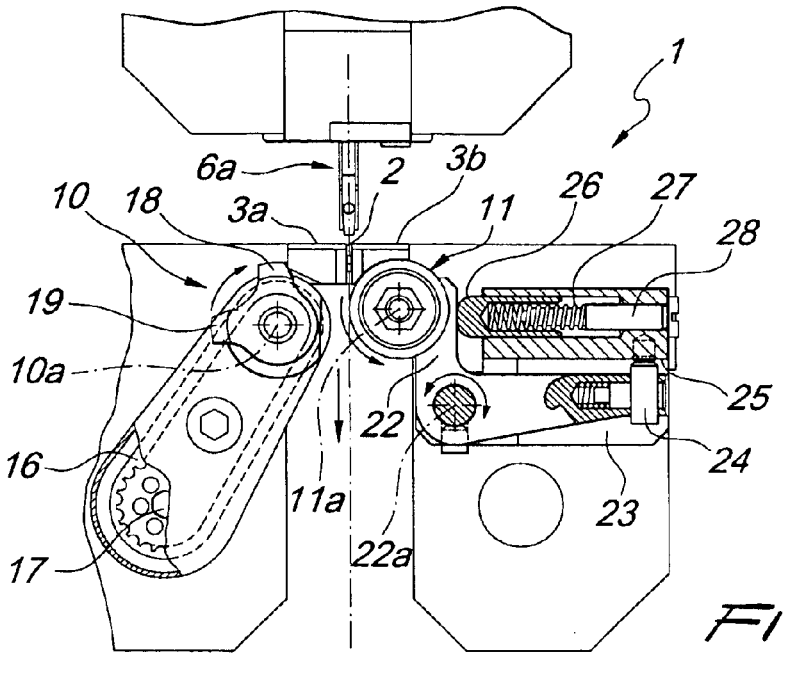
FIG. 1 is a partially sectional front elevation view of the device according to the invention, prior to the engagement of the tensioning means with the hosiery item.

With reference to the figures, the device according to the invention, generally designated by the reference numeral 1, is designed to be fitted proximate to the inlet of the passage 2 of the conveyor of a sewing machine for closing the toe of hosiery items by sewing.

The conveyor of the sewing machine is composed, in a per se known manner, of two laminas 3*a*, 3*b* that lie on a substantially horizontal plane and are arranged laterally side by side so that the passage 2, in which a portion of the hosiery item 4 proximate to the toe to be closed by sewing must be inserted, is formed between said laminas.

The hosiery item 4 is preferably formed, in a per se known manner, at the open toe that is designed to be closed by sewing, with an additional portion that is constituted, starting from the body 4*a* of the hosiery item and continuing toward the end or toe to be closed by sewing, by a certain number of rows of knitting 4*b*, which are formed with an elastic thread of reduced diameter so as to have a reduced thickness, and with a final border 4*c*, which is made of threads having a larger diameter so as to be significantly thicker than at the rows 4*b* and thicker than the width of the passage 2.

The hosiery item 4, upstream of the device according to the invention along its direction of insertion within the passage 2, designated by the arrow 5, hangs, at the toe to be closed, from a pair of grippers 6*a*, 6*b*, which are inserted in the opening of the toe and engage two diametrically opposite regions of the border 4*c*. The grippers 6*a* and 6*b* may be constituted for example by the grippers disclosed in U.S. Ser. No. 10/459,526 cited above, or by other grip and support means capable of inserting the hosiery item in the passage 2.

The grippers 6*a*, 6*b* can move apart, so as to tension the hosiery item 4 at the opening of the toe to be closed in order to flatten the two flaps of the opening that face each other, arranging the toe of the hosiery item in a condition that is suitable for its insertion into the passage 2 between the pair of laminas 3*a*, 3*b*.

The device according to the invention comprises tensioning means, which are arranged below the pair of laminas 3*a*, 3*b* and can engage a portion of the hosiery item 4 that hangs at the opening of the toe to be closed by sewing so that the two flaps of the opening face each other. The tensioning means can be actuated in order to tension the hosiery item 4 downwardly during its insertion into the passage 2.

The tensioning means can engage the outer sides of the two flaps of the hosiery item 4, so as to make the border 4*c* rest, substantially along its entire extension, against the upper face of the laminas 3*a*, 3*b* during the insertion of the hosiery item 4 in the passage 2.

The tensioning means preferably comprise a pair of rollers 10, 11, which contrarotate about respective axes 10*a*, 11*a*, which are substantially horizontal and parallel to the longitudinal axis of the passage 2, i.e., parallel to the insertion direction 5. The rollers 10, 11 face with their lateral surface, on opposite sides, an imaginary vertical plane that passes through the longitudinal axis of the passage 2, so as to face the outer sides of the two mutually facing flaps of the hosiery item 4 during its insertion into the passage 2.

The pair of rollers 10, 11 comprises a first roller 10, which can be rotationally actuated about its own axis 10*a*, and a second roller 11, which is supported so that it can rotate freely about its own axis 11*a* and can rotate by contact with the first roller 10 with the interposition of the two flaps of the hosiery item 4.

More particularly, the first roller 10 is keyed to the end of a shaft 12 that is supported, so that it can rotate about its own axis, which coincides with the axis 10*a*, by a supporting structure 13 by interposing bearings 14. A pulley 15 is keyed to the end of the shaft 12 that is opposite with respect to the end provided with the roller 10; said pulley is connected, by means of a belt 16, to a motor shaft 17, which can be actuated, for example by means of an electric motor, so that it rotates about its own axis, so as to turn the roller 10 about its own axis 10*a*.

The shaft 17 can be actuated autonomously or can be connected to the motor that drives the various components of the sewing machine.

The second roller 11 is substantially cylindrical, with an initial portion 11*b*, starting from its axial end that is first reached by the hosiery item 4 in its advancement toward the passage 2, which is shaped like a frustum, with a diameter that gradually increases along the direction of advancement 5 of the hosiery item 4 toward the passage 2.

The first roller 10 has a shape provided with a substantially cylindrical main lateral surface and with at least one tooth that protrudes radially from said lateral surface.

Preferably, the first roller 10 has a first tooth 18 and a second tooth 19, which protrude radially from its main lateral surface and are angularly spaced with respect to each other about the axis 10*a* of the first roller 10.

The first tooth 18 has a profile that is contoured like a portion of a conical surface whose axis coincides with the axis 10*a*, with a diameter that increases along the direction of advancement 5. The first tooth 18, which covers a limited portion of the axial extension of the first roller 10 starting from the axial end of the roller 10 that is first reached by the hosiery item 4 in its advancement along the direction 5, laterally faces, during the rotation of the first roller 10 about its own axis 10*a*, the initial portion 11*b* of the second roller 11.

The second tooth 19 has, starting from the axial end of the roller 10 that is first reached by the hosiery item 4 in its advancement along the direction 5, a first portion 19*a* that is substantially shaped like the first tooth 18 and a second portion 19*b* that is formed as a continuation of the first portion 19*a* and is substantially shaped like a portion of a cylindrical surface whose axis coincides with the axis 10*a*. The second portion 19*b* laterally faces, during the rotation of the first roller 10 about its own axis 10*a*, the cylindrical portion of the second roller 11.

The second roller 11 is arranged at such a distance from the first roller 10 that the first roller 10, in rotating about its own axis 10*a*, does not substantially hinder, with its main lateral surface, the advancement motion of the hosiery item 4 toward the passage 2.

Conveniently, means are provided for adjusting the minimum distance of the second roller 11 from the first roller 10.

Moreover, elastic means are provided that elastically contrast the movement of the second roller 11 away from the first roller 10 due to the insertion of the hosiery item 4 between the two rollers 10 and 11.

More particularly, the second roller 11 is mounted, with an interposed bearing 20, on a shaft 21, fixed to the end of a lever 22, which is pivoted, in an intermediate region of its extension, to a supporting element 23 about a rotation axis 22*a* that is parallel to the axes 10*a*, 11*a* of the rollers 10, 11.

At the end of the lever 22 that lies opposite the end that supports the second roller 11 there is a grub screw 24, which rests against a fixed abutment 25 of the supporting element 23, delimiting the rotation of the lever 22 about the axis 22*a* in the direction of rotation that makes the second roller 11 approach the first roller 10, constituting thus the distance adjustment means. The position of maximum approach of the roller 11 to the roller 10 can be adjusted, by acting on the grub screw 24, so that the first roller 10, when it faces the second roller 11 with its main lateral surface, does not substantially hinder the advancement of the hosiery item 4 along the direction 5.

A piston 26 acts on the lever 22 and is pushed by elastic means, in particular by a spring 27 that elastically contrasts the rotation of the lever 22 about the axis 22*a* in the direction of rotation that moves the second roller 11 away from the first roller 10. The loading of the spring 27 can be adjusted by elastic force adjustment means, in particular constituted by a screw 28.

The position of the rollers 10, 11 with respect to the laminas 3*a*, 3*b* of the conveyor of the sewing machine is such that an imaginary vertical plane that is perpendicular to the longitudinal axis of the passage 2 and passes through the insertion end of the passage 2 intersects an intermediate region of the axial extension of the cylindrical region of the second roller 11 and of the portion 19*b* of the second tooth 19 of the first roller 10.

Preferably, at least the lateral surface of the cylindrical portion of the second roller 11 has a surface with increased friction, in particular a knurled surface in order to increase the grip of the roller 11 against the hosiery item 4.

Operation of the device according to the invention is as follows.

Figure 2:
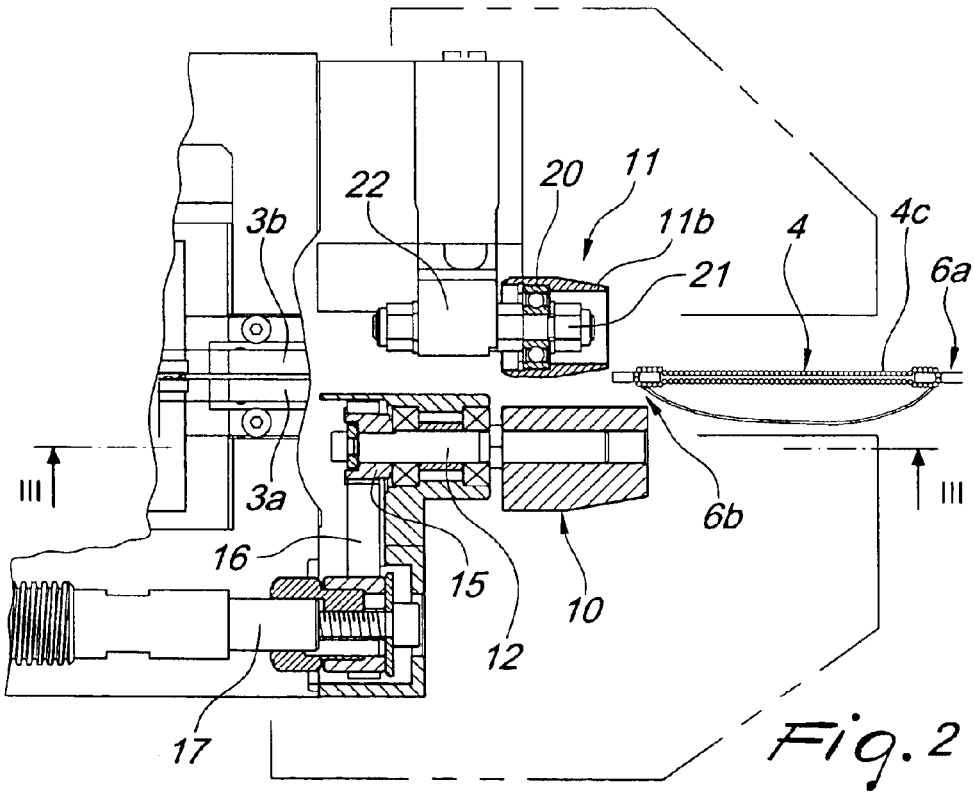
FIG. 2 is a partially sectional top plan view of the device according to the invention in the operating condition that corresponds to FIG. 1.
Figure 3:
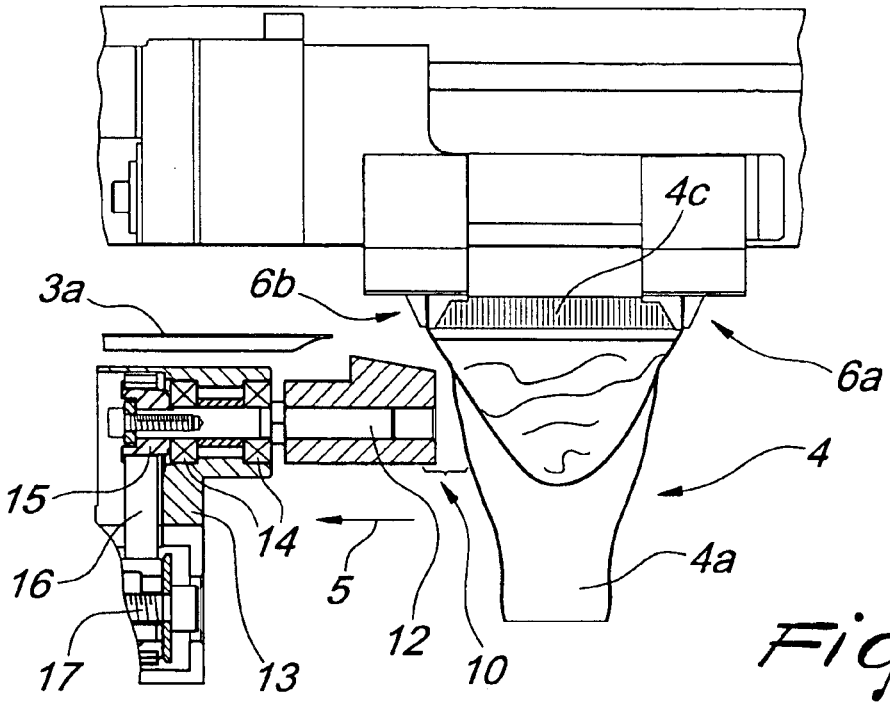
FIG. 3 is a sectional view of FIG. 2, taken along the line III—III.

The hosiery item 4, which hangs from the grippers 6*a*, 6*b* with its border 4*c* held at a slightly higher level than the plane of arrangement of the laminas 3*a*, 3*b*, is moved, so that the two flaps of the opening of the toe face each other and are aligned with the passage 2, along the direction 5 in order to insert it in the passage 2 at the region affected by the rows 4*b* (FIGS. 1 to 3).

Figure 4:
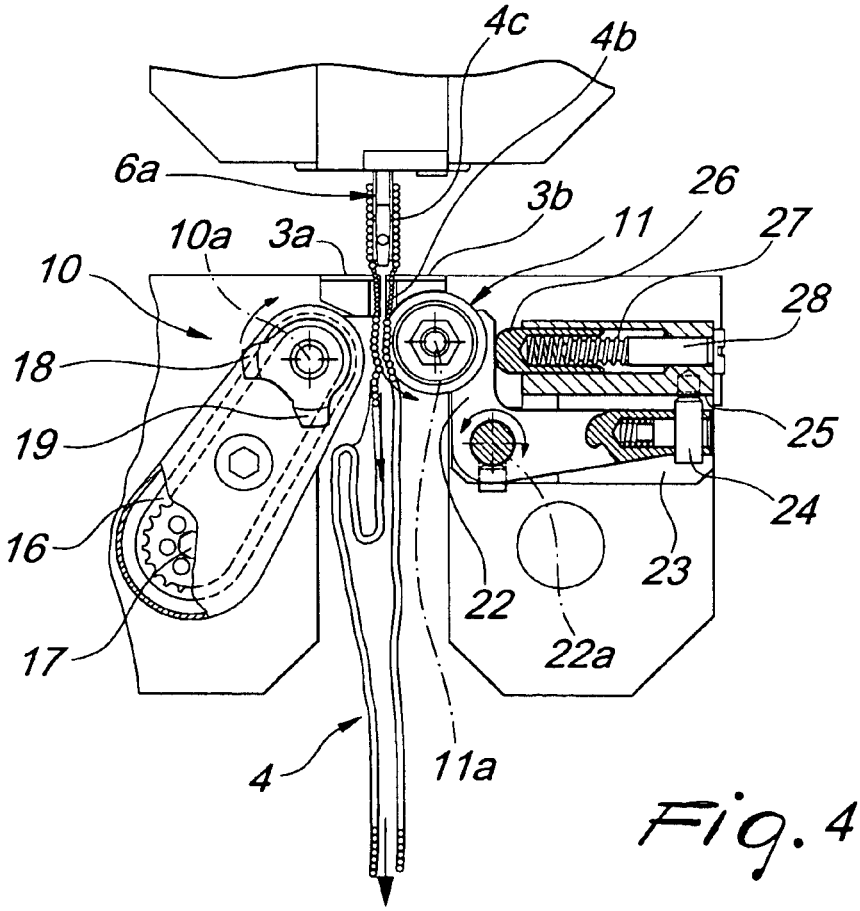
FIG. 4 is a partially sectional front elevation view of the device according to the invention, with the tensioning means engaged with the hosiery item prior to its insertion in the passage of the conveyor.
Figure 5:
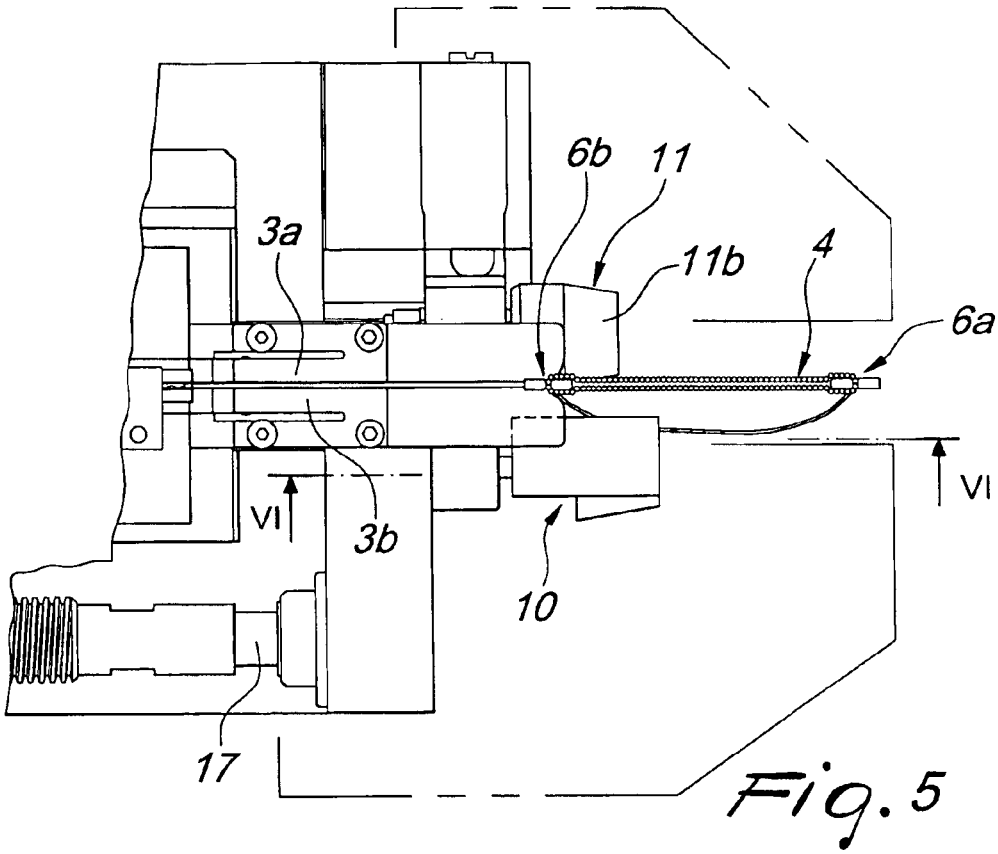
FIG. 5 is a top plan view of the device according to the invention in the operating condition that corresponds to FIG. 4.
Figure 6:
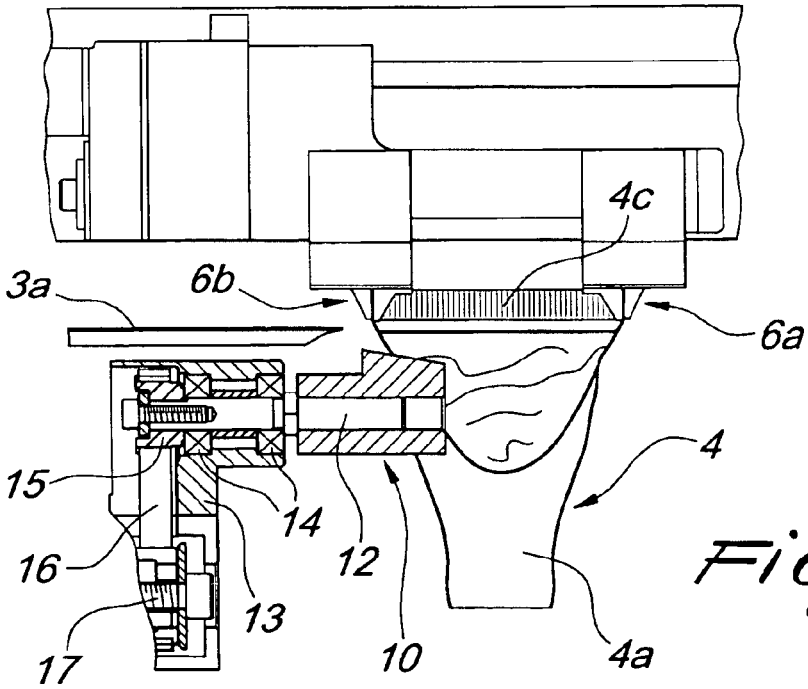
FIG. 6 is a sectional view of FIG. 5, taken along the line VI—VI.

In its advancement toward the passage 2, the hosiery item 4 is inserted between the rollers 10, 11. The first roller 10, actuated with a rotary motion about its own axis 10*a*, during the advancement of the hosiery item 4 toward the passage 2 cyclically affects, with the teeth 18, 19, the hosiery item 4, pressing it against the second roller 11, which is thus turned about its own axis 11*a* (FIGS. 4 to 6).

Figure 7:
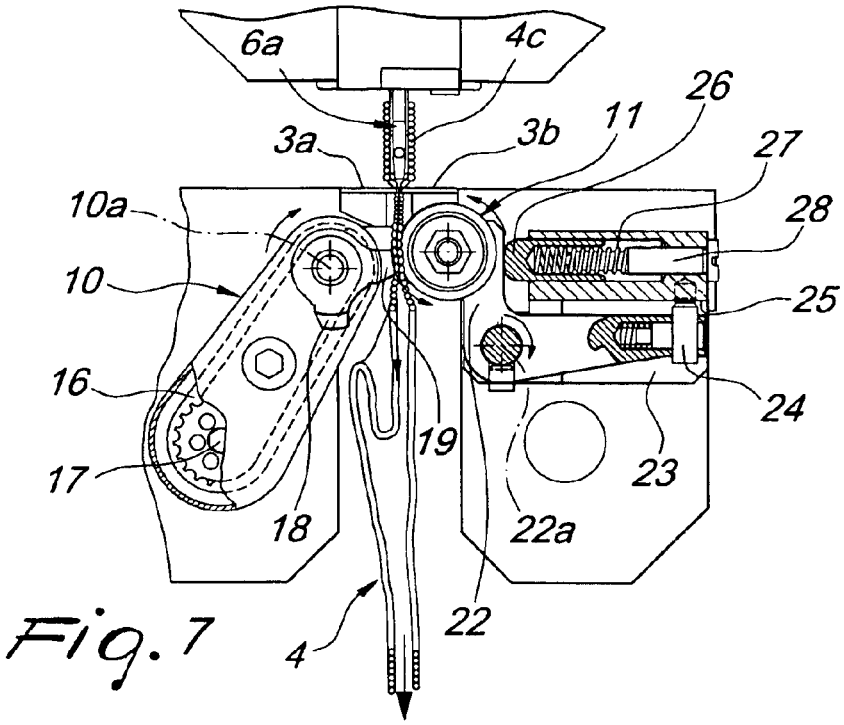
FIG. 7 is a partially sectional front elevation view of the device according to the invention during insertion of the hosiery item in the passage of the conveyor.
Figure 8:
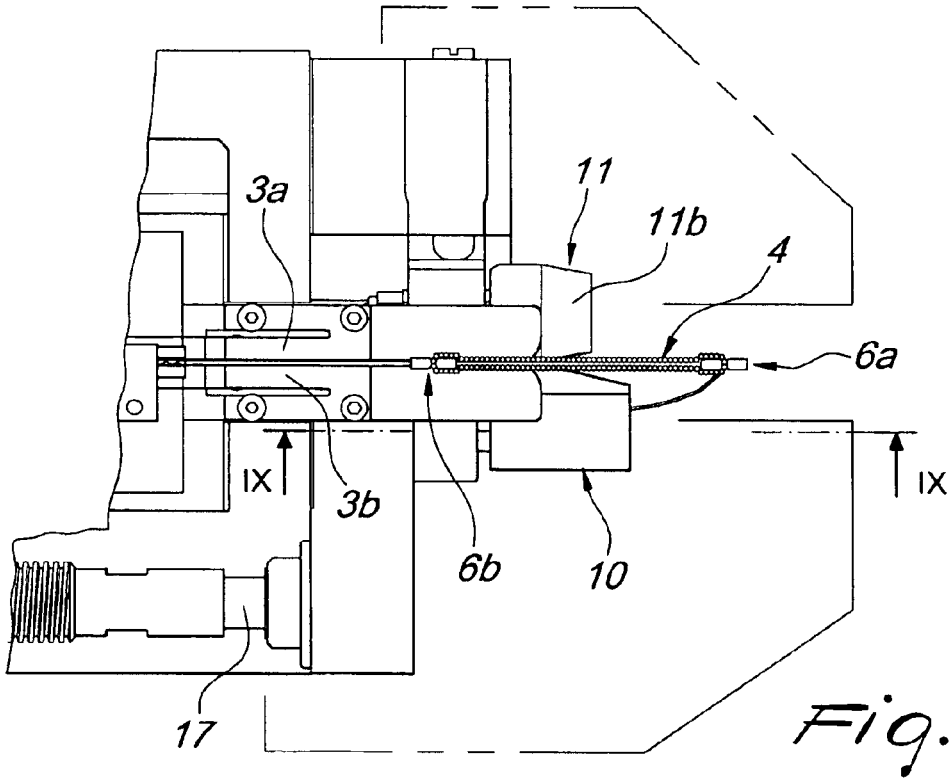
FIG. 8 is a top plan view of the device according to the invention in the operating condition that corresponds to FIG. 7.
Figure 9:
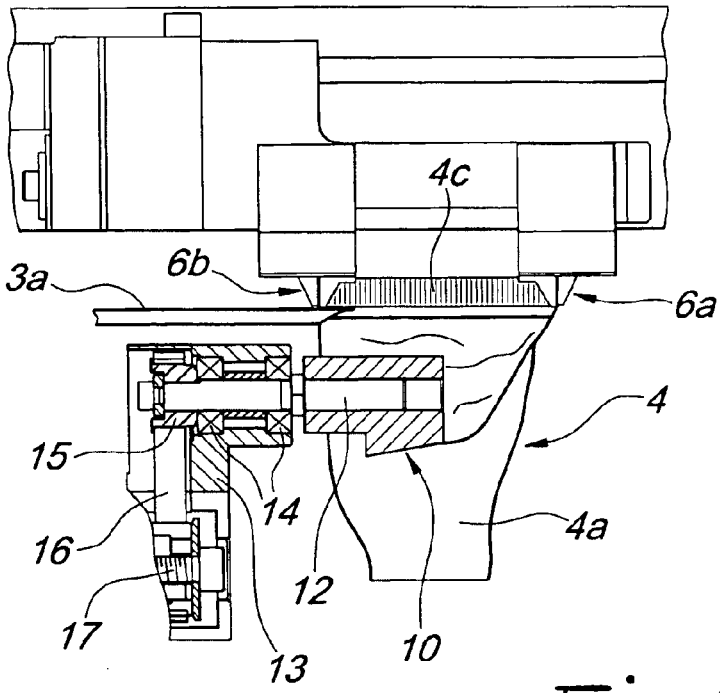
FIG. 9 is a sectional view of FIG. 8, taken along the line IX—IX.
Figure 10:
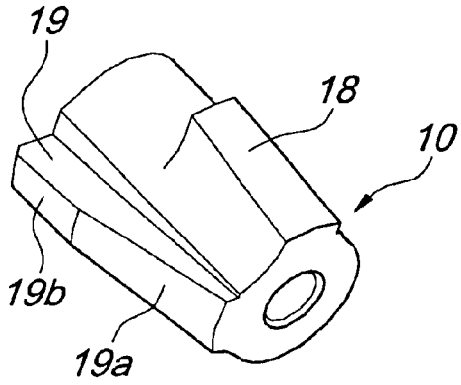
FIG. 10 is a perspective view of one of the tensioning means.
Figure 11:
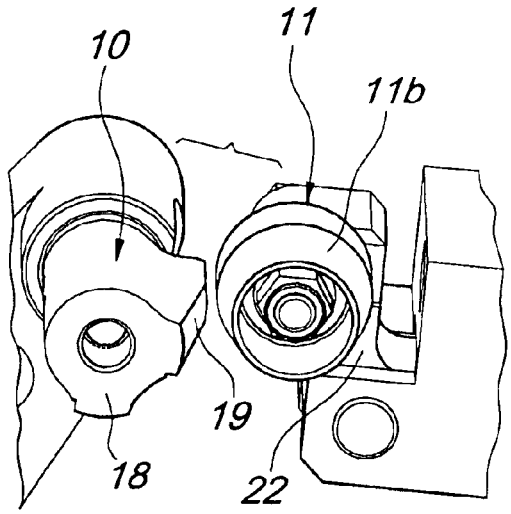
FIG. 11 is a perspective view of the tensioning means.

It should be noted that the initial portion 11*b* of the second roller 11 and the shape of the first tooth 18 and of the portion 19*a* of the second tooth 19 of the roller 10 constitute a guide for the correct insertion of the hosiery item 4 between the rollers 10 and 11, while the cylindrical portion of the second roller 11 and the portion 19*b* of the second tooth 19 of the first roller 10 engage the outer sides of the two mutually facing flaps of the hosiery item 4, pulling them downwardly while the hosiery item 4 is inserted in the passage 2 (FIGS. 7 to 9).

This traction has the effect of achieving the reliable resting, over its entire extension, of the border 4*c* against the upper face of the laminas 3*a*, 3*b*, achieving excellent precision in the placement of the hosiery item 4 during its insertion in the passage 2.

The tension applied by the rollers 10, 11 to the hosiery item 4 also has the effect of further reducing the thickness of the rows 4*b*, facilitating the insertion of said rows in the passage 2.

It should be noted that the particular shape of the first roller 10 achieves a cyclic engagement of the rollers 10, 11 with the hosiery item 4, so as to allow the hosiery item 4 to advance along the passage 2. The degree of downward tension applied to the hosiery item 4 is proportional to the ratio between the rotation rate of the roller 10 and the advancement speed of the grippers 6*a*, 6*b* along the direction 5.

After the hosiery item 4 has been inserted completely into the passage 2, the action of the rollers 10 and 11 on the hosiery item 4 ceases, and the hosiery item is made to advance along the passage 2 by the traction means with which the sewing machine is equipped.

It should be noted that the minimum distance between the rollers 10 and 11 can be adjusted, according to the thickness of the hosiery item 4, by acting on the grub screw 24, and the pressure of the rollers 10 and 11 on the hosiery item 4 can be adjusted by acting on the adjustment screw 28.

In practice it has been found that the device according to the invention fully achieves the intended aim, since by ensuring precise resting of the end border of the toe of the hosiery item to be sewn against the upper face of the laminas of the conveyor of the sewing machine it ensures the correct placement of the hosiery item in input to the sewing machine and therefore ensures correct execution of the seam, leading to a fully satisfactory sewing result.

Although the device according to the invention has been conceived in particular in order to equip a machine of the type disclosed in U.S. Ser. No. 10/459,526, it can in any case be used more generally to equip conveyors arranged in input to sewing machines of a known type, in order to achieve a precise placement of the hosiery item during its insertion into the conveyor.

The device thus conceived is susceptible of numerous modifications and variations, all of which are within the appended claims; all the details may further be replaced with other technically equivalent elements.

In practice, the materials used, as well as the dimensions, may be any according to requirements and to the state of the art.

The disclosures in Italian Patent Application No. MI2003A000896 from which this application claims priority are incorporated herein by reference.

What is claimed is:

1. A device for precise placement of a toe of a hosiery item during automated insertion thereof in a conveyor of a sewing machine for closing by sewing an opening of the toe formed between two flaps thereof, the conveyor being composed of two laminas arranged side by side on a substantially horizontal plane so as to form therebetween a passage for a portion of the hosiery item to be inserted that is proximate to the toe to be closed by sewing, the device comprising tensioning means, which are arranged proximate to an inlet of said passage, below said pair of laminas so as to engage a portion of the hosiery item that hangs at the opening of the toe to be closed by sewing so that the two flaps of the opening face each other, said tensioning means being actuatable in order to exert a tension force on the hosiery item, during insertion thereof in said passage, that is directed downwardly, said tensioning means comprising a pair of contrarotating rollers directed along respective axes which are substantially parallel to a longitudinal axis of said passage, said rollers comprising a first roller having a substantially cylindrical main lateral surface and at least one tooth that protrudes radially from said lateral surface, and a second roller which is arranged at such a distance from said first roller that said first roller, during rotation about the axis thereof, prevents the main lateral surface thereof from hindering the advancement of the hosiery item toward said passage and affects, with said at least one tooth, the hosiery item by pressing it against the second roller.

2. A device for precise placement of a toe of a hosiery item during automated insertion thereof in a conveyor of a sewing machine for closing by sewing an opening of the toe formed between two flaps thereof, the conveyor being composed of two laminas arranged side by side on a substantially horizontal plane so as to form therebetween a passage for a portion of the hosiery item to be inserted that is proximate to the toe to be closed by sewing, the device comprising tensioning means, which are arranged proximate to an inlet of said passage, below said pair of laminas so as to engage a portion of the hosiery item that hangs at the opening of the toe to be closed by sewing so that the two flaps of the opening face each other, said tensioning means being actuatable in order to cyclically exert a tension force on the hosiery item, during insertion thereof in said passage, that is directed downwardly said hosiery item being hung at one end border, arranged above said laminas, which is provided thicker than a width of said passage and thicker than a thickness of the portion of the hosiery item to be inserted in said passage, said tensioning means being in engagement with outer sides of the two flaps of the hosiery item with said end border resting against an upper face of said laminas during insertion of the hosiery item in said passage.

3. The device of claim 2, wherein said tensioning means comprise two contrarotating rollers, which rotate about corresponding substantially horizontal axes thereof that are parallel to a longitudinal axis of said passage, said rollers having cylindrical lateral surfaces that face, on opposite sides, an imaginary vertical plane that passes through the longitudinal axis of said passage in order to face outer sides of said two mutually facing flaps of the hosiery item during insertion thereof in said passage.

4. The device of claim 3, wherein said pair of rollers comprises a first roller, which is actuatable with a rotary motion about the axis thereof, and a second roller, which is supported freely about the axis thereof and is rotatable due to contact with said first roller following to interposition of said two flaps of the hosiery item.

5. The device of claim 3, wherein said second roller is substantially cylindrical, with an initial portion, starting from an axial end thereof that is first reached by the hosiery item during advancement thereof toward said passage, that is shaped like a frustum, with a diameter that gradually increases along a direction of advancement of the hosiery item toward said passage.

6. The device of claim 5, wherein said first roller is shaped so that as to have a substantially cylindrical main lateral surface and at least one tooth that protrudes radially from said lateral surface.

7. The device of claim 5, wherein said first roller has a first tooth and a second tooth that protrude from a lateral surface thereof and are angularly spaced from each other around the axis of said first roller.

8. The device of claim 7, wherein said first tooth has a profile that is substantially contoured so as to form a portion of a conical surface an axis whereof coincides with the axis of said first roller and a diameter whereof increases along the direction of advancement of the hosiery item toward said passage; said first tooth facing laterally, during the rotation of said first roller about the axis thereof, said initial portion of said second roller.

9. The device of claim 8, wherein said second tooth has a first portion that has a shape that is similar to that of said first tooth and a second portion that is provided as a continuation of said first portion and is shaped as a portion of a cylindrical surface having an axis that coincides with the axis of said first roller; said second portion of the second tooth laterally facing, during rotation of said first roller about the axis thereof, the cylindrical portion of said second roller.

10. The device of claim 9, wherein said second roller is arranged at such a distance from said first roller that said first roller, during rotation about the axis thereof, prevents the lateral surface thereof from hindering the advancement of the hosiery item toward said passage.

11. The device of claim 10, comprising adjustment means for adjusting a minimum distance of said second roller from said first roller.

12. The device of claim 11, comprising elastic means that contrast elastically movement of said second roller away from said first roller due to the insertion of the hosiery item between said two rollers.

13. The device of claim 12, comprising elastic force adjustment means for adjusting an elastic force that contrasts the movement of said second roller away from said first roller.

14. The device of claim 9, wherein said second portion having a cylindrical surface of said second tooth of the first roller and the cylindrical portion of said second roller are arranged so as to be intersected by an imaginary vertical plane that passes through the input end of said passage and is perpendicular to the longitudinal axis of said passage, in an intermediate region of an axial extension thereof.

15. The device of claim 9, wherein at least the lateral surface of said cylindrical portion of the second roller has a high friction surface.

16. The device of claim 1, wherein said first roller further comprises a second tooth that protrudes from a lateral surface thereof and is angularly spaced from said first tooth around an axis of said first roller.

17. The device of claim 16, wherein said second roller is substantially cylindrical, with an initial portion, starting from an axial end thereof that is first reached by the hosiery item during advancement thereof toward said passage, that is shaped like a frustum, with a diameter that gradually increases along a direction of advancement of the hosiery item toward said passage, and wherein said first tooth of said first roller has a profile that is substantially contoured so as to form a portion of a conical surface an axis whereof coincides with the axis of said first roller and a diameter whereof increases along the direction of advancement of the hosiery item toward said passage; said first tooth facing laterally, during the rotation of said first roller about the axis thereof, said initial portion of said second roller.

18. The device of claim 16, wherein said first tooth has a profile that is substantially contoured so as to form a portion of a conical surface an axis whereof coincides with the axis of said first roller and a diameter whereof increases along the direction of advancement of the hosiery item toward said passage; said first tooth facing laterally, during the rotation of said first roller about the axis thereof, said initial portion of said second roller.

19. The device of claim 18, wherein said second tooth has a first portion that has a shape that is similar to that of said first tooth and a second portion that is provided as a continuation of said first portion and is shaped as a portion of a cylindrical surface having an axis that coincides with the axis of said first roller; said second portion of the second tooth laterally facing, during rotation of said first roller about the axis thereof, the cylindrical portion of said second roller.

20. The device of claim 19, wherein said second roller is arranged at such a distance from said first roller that said first roller, during rotation about the axis thereof, prevents the lateral surface thereof from hindering the advancement of the hosiery item toward said passage.

21. The device of claim 20, comprising adjustment means for adjusting a minimum distance of said second roller from said first roller.

22. The device of claim 21, comprising elastic means that contrast elastically movement of said second roller away from said first roller due to the insertion of the hosiery item between said two rollers.

23. The device of claim 22, comprising elastic force adjustment means for adjusting an elastic force that contrasts the movement of said second roller away from said first roller.

24. The device of claim 19, wherein said second portion having a cylindrical surface of said second tooth of the first roller and the cylindrical portion of said second roller are arranged so as to be intersected by an imaginary vertical plane that passes through the input end of said passage and is perpendicular to the longitudinal axis of said passage, in an intermediate region of an axial extension thereof.

25. The device of claim 19, wherein at least the lateral surface of said cylindrical portion of the second roller has a high friction surface.

26. A device for precise placement of a toe of a hosiery item during automated insertion thereof in a conveyor of a sewing machine for closing by sewing an opening of the toe formed between two flaps thereof, the conveyor being composed of two laminas arranged side by side on a substantially horizontal plane so as to form therebetween a passage for a portion of the hosiery item to be inserted that is proximate to the toe to be closed by sewing, the device comprising a tensioning device, which is arranged proximate to an inlet of said passage, below said pair of laminas so as to engage a portion of the hosiery item that hangs at the opening of the toe to be closed by sewing so that the two flaps of the opening face each other, said tensioning device being actuatable in order to exert a tension force on the hosiery item, during insertion thereof in said passage, that is directed downwardly, said tensioning device comprising a first roller having a substantially cylindrical main lateral surface and at least one tooth that protrudes radially from said lateral surface, and a second roller which can rotate by contact with said at least one tooth of said first roller with the interposition of the two flaps of the hosiery item.

* * * * *